US007443994B2

(12) United States Patent
Suzuki

(10) Patent No.: US 7,443,994 B2
(45) Date of Patent: Oct. 28, 2008

(54) GASKET AND SPEAKER APPARATUS

(75) Inventor: Tatsuya Suzuki, Yamagata (JP)

(73) Assignees: Pioneer Corporation, Tokyo (JP); Tohoku Pioneer Corporation, Yamagata (JP)

( * ) Notice: Subject to any disclaimer, the term of this patent is extended or adjusted under 35 U.S.C. 154(b) by 507 days.

(21) Appl. No.: 11/045,327

(22) Filed: Jan. 31, 2005

(65) Prior Publication Data

US 2005/0175211 A1 Aug. 11, 2005

(30) Foreign Application Priority Data

Feb. 10, 2004 (JP) ..... P2004-034263

(51) Int. Cl.
*H04R 1/02* (2006.01)

(52) U.S. Cl. ..... 381/386; 381/391; 381/395

(58) Field of Classification Search ..... 381/150, 381/345, 386, 395, 396, 391; 181/148, 150, 181/198, 199; 361/600, 679, 807
See application file for complete search history.

(56) References Cited

U.S. PATENT DOCUMENTS 6,594,155 B2 * 7/2003 Kuroda ..... 361/807
6,661,902 B1 * 12/2003 Ziegler et al. ..... 381/386

FOREIGN PATENT DOCUMENTS

JP 11-4493 A 1/1999

* cited by examiner

*Primary Examiner*—Brian Ensey
(74) *Attorney, Agent, or Firm*—Sughrue Mion, PLLC

(57) ABSTRACT

In a gasket which is interposed between a speaker unit and a cabinet to which the speaker unit is attached, a dust-proof net is secured to an annular portion, which is clamped between the speaker unit and the cabinet, and supporting ribs configured integrally on an inner side of the annular portion.

2 Claims, 4 Drawing Sheets

GASKET AND SPEAKER APPARATUS

CROSS-REFERENCE TO RELATED APPLICATION

The invention claims priority to Japanese Patent Application No. JP 2004-034263 filed on Feb. 10, 2004. The disclosure of the prior application is incorporated herein by reference in its entirety.

BACKGROUND OF THE INVENTION

1. Field of the Invention

The present invention relates to a gasket and a speaker apparatus.

2. Description of the Related Art

A conventional speaker apparatus is required to be as compact and lightweight as possible, and attempts have been made to simplify a configuration by reducing a number of component parts in such as a structure of assembling a dust-proof net which is disposed on a front surface side of a speaker unit.

FIGS. 1 and 2 show a conventional example of the structure of assembling the dust-proof net in such a speaker apparatus (refer to JP-A-11-4493, for example).

A speaker apparatus 1 shown in FIG. 1 is configured such that a speaker unit 3 is clamped and fixed to a cabinet 7 of a portable apparatus by means of a speaker holder 5 which is fitted thereto from its rear. A dust-proof net 11 is attached to a front surface of an annular spacer (gasket) 9 for closing a gap between the cabinet 7 and the speaker unit 3.

As shown in FIG. 2, the speaker unit 3 is configured such that a cone-type diaphragm 3*b* is fitted to a front surface of a frame 3*a* in which a magnetic circuit and the like are incorporated.

The speaker holder 5 configured with an annular holder body 5*a* for pressing an outer peripheral edge of the frame 3*a* of the speaker unit 3 and attaching flange portions 5*b* provided integrally on an outer periphery of this holder body 5*a*. The speaker holder 5 is fixed to the cabinet 7 by screwing down the flange portions 5*b* to attaching bosses 7*a* provided on the cabinet 7 side with screws 8.

A plurality of small-diameter sound holes 7*b* are penetratingly formed in the cabinet 7 over a range of the speaker shape.

The spacer 9 is a simple ring-shaped plate member for pressing the outer peripheral edge of the diaphragm 3*b*, and is capable of adjusting fixing pressure of the speaker.

The dust-proof net 11 is formed by cutting out a lightweight mesh sheet, which is fabricated from nylon fibers or the like, in conformity with an outside diameter of the spacer 9. The dust-proof net 11 is integrated with the spacer 9 as its outer peripheral edge is attached to a front surface of the spacer 9.

SUMMARY OF THE INVENTION

However, the dust-proof net 11 in the above-described speaker apparatus 1 is fixed by adhering only its outer peripheral edge to the spacer 9, and its adhering area is extremely small relative to a size of the dust-proof net 11. Therefore, it is difficult to secure sufficient adhering strength, and there are cases where slackening or exfoliation can occur in the dust-proof net 11 due to expansion and shrinkage of the dust-proof net 11 caused by temperature changes or humidity changes. In consequence, the dust-proof net 11 in which the slackening or exfoliation has occurred generates abnormal noise by resonating with a vibration of the diaphragm 3*b* of the speaker unit 3, which can be cited as one example problem.

According to an embodiment of the invention, there is provided a gasket interposed between a speaker unit and a cabinet to which the speaker unit is attached, including: a dust-proof net; an annular portion clamped between the speaker unit and the cabinet; and a supporting rib configured integrally on an inner side of the annular portion, wherein the dust-proof net is secured to the annular portion and the supporting rib.

In addition, according to an embodiment of the invention, there is provided a speaker apparatus including: a gasket interposed between a speaker unit and a cabinet to which the speaker unit is attached, wherein the gasket is integrally configured with: an annular portion clamped between the speaker unit and the cabinet; and a supporting rib configured integrally on an inner side of the annular portion, and a dust-proof net is secured to the annular portion and the supporting rib.

BRIEF DESCRIPTION OF THE DRAWING

These and other objects and advantages of this invention will become more fully apparent from the following detailed description taken with the accompanying drawings in which.

DETAILED DESCRIPTION OF THE PREFERRED EMBODIMENTS

Figure 1:
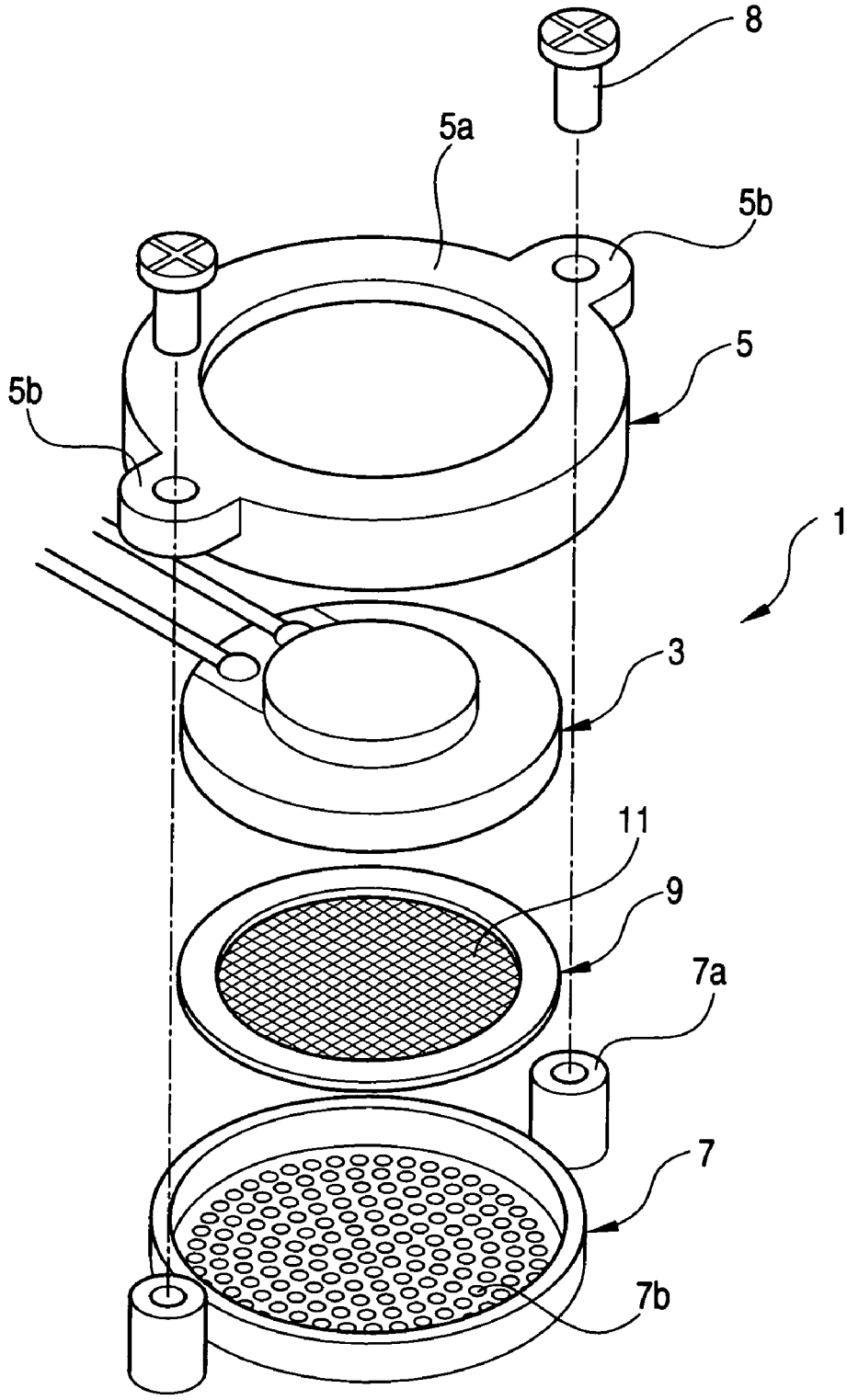
FIG. 1 PRIOR ART
FIG. 1 is an exploded perspective view of a conventional speaker apparatus.
Figure 2:
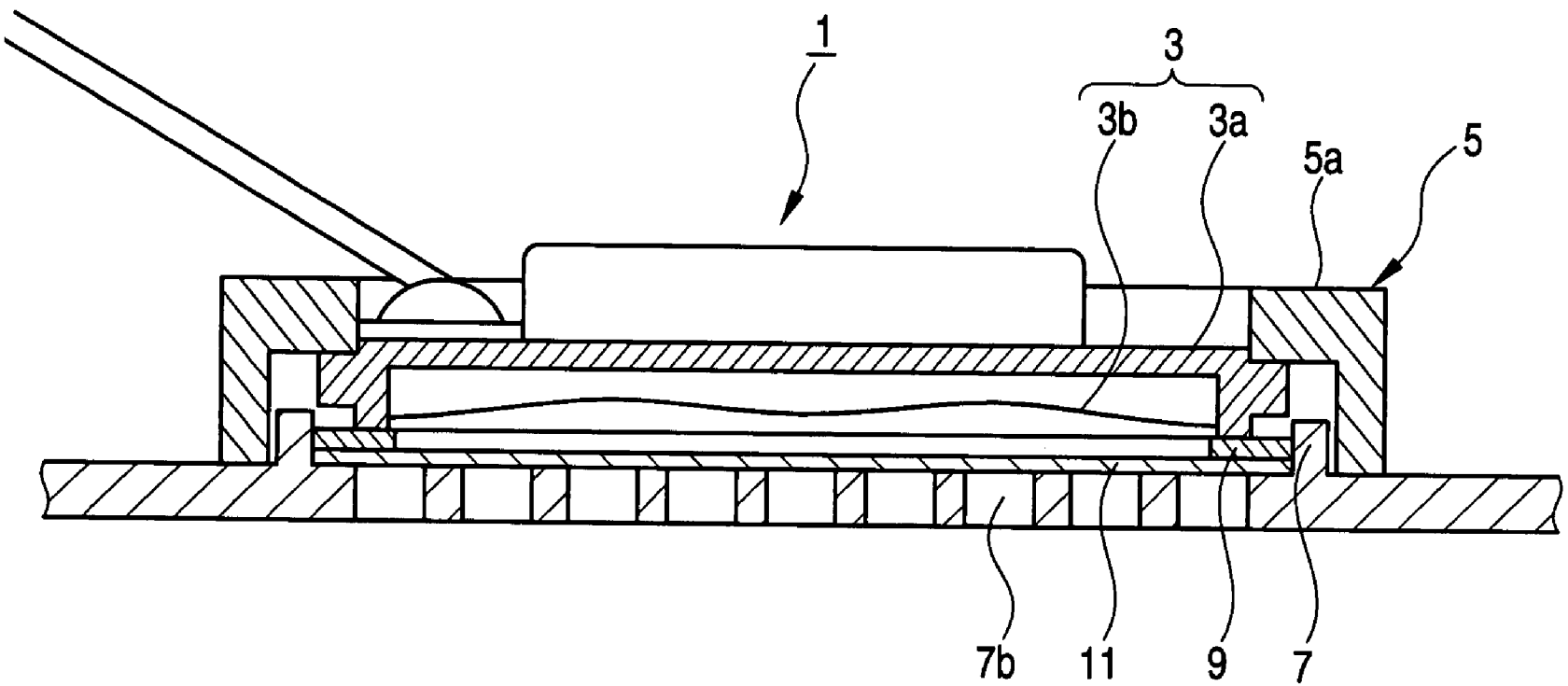
FIG. 2 PRIOR ART
FIG. 2 is a vertical cross-sectional view of the speaker apparatus shown in FIG. 1.

A description of a gasket and a speaker apparatus according to an embodiment of the invention will be given.

The gasket of the invention is a gasket which is interposed between a speaker unit and a cabinet to which the speaker unit is attached, wherein a dust-proof net is secured to an annular portion, which is clamped between the speaker unit and the cabinet, and supporting ribs configured integrally on an inner side of the annular portion.

Namely, since the supporting ribs, which are configured integrally on the inner side of the annular portion of the gasket, function as fixing portions for both the annular portion and the dust-proof net, a fixing area with respect to the dust-proof net increases. Hence, it is possible to secure sufficient fixing strength by virtue of an increase in the fixing area.

Accordingly, it is possible to reduce expansion and shrinkage of the dust-proof net due to temperature changes or humidity changes, thereby making it possible to prevent the occurrence of slackening or exfoliation in the dust-proof net. In addition, it is possible to prevent the slackening of the dust-proof net at the time of heat welding by ultrasonic welding or the like.

Furthermore, the supporting ribs include straight ribs provided along a radial direction of the annular portion and an annular rib provided concentrically on the inner side of the annular portion in such a manner as to intersect the straight ribs. Therefore, the ribs having different extending directions are joined in such a manner as to intersect each other, and directions in which the strength of the gasket itself is increased by the ribs become multiple directions. Hence, it is possible to realize uniformly increased strength which has no directionality over an entire region of the gasket.

Moreover, a fixed surface of the gasket with respect to the dust-proof net are uniformly dispersed over the substantially entire region of the dust-proof net by virtue of a presence of the straight ribs and the annular rib disposed in such a manner as to intersect each other. Therefore, it is possible to make small and uniform intervals between fixed portions of the gasket with respect to the dust-proof net, and effectively suppress the occurrence of the slackening and exfoliation of the dust-proof net.

In addition, the speaker apparatus of the invention is a speaker apparatus in which a gasket, is interposed between a speaker unit and a cabinet to which the speaker unit is attached, wherein the gasket has a structure in which an annular portion, which is clamped between the speaker unit and the cabinet, and supporting ribs configured integrally on an inner side of the annular portion are integrally formed, and a dust-proof net is secured to the annular portion and the supporting ribs.

Namely, the gasket in the speaker apparatus has a structure in which the annular portion, which is clamped between the speaker unit and the cabinet, and supporting ribs configured integrally on the inner side of the annular portion are integrally formed, and the dust-proof net is secured to the annular portion and the supporting ribs.

Accordingly, since the supporting ribs which are configured integrally on the inner side of the annular portion of the gasket function as fixing portions for both the annular portion and the dust-proof net, the fixing area with respect to the dust-proof net increases. Hence, it is possible to secure sufficient fixing strength by virtue of an increase in the fixing area.

Therefore, it is possible to reduce the expansion and shrinkage of the dust-proof net due to temperature changes or humidity changes, thereby making it possible to prevent the occurrence of the slackening or exfoliation in the dust-proof net. Further, it is possible to prevent the dust-proof net in which the slackening or exfoliation has occurred from generating abnormal noise by resonating with the vibration of the speaker unit.

Embodiment

Hereafter, referring to the drawings, a detailed description will be given of the gasket and the speaker apparatus according to the embodiment of the invention.

Figure 3:
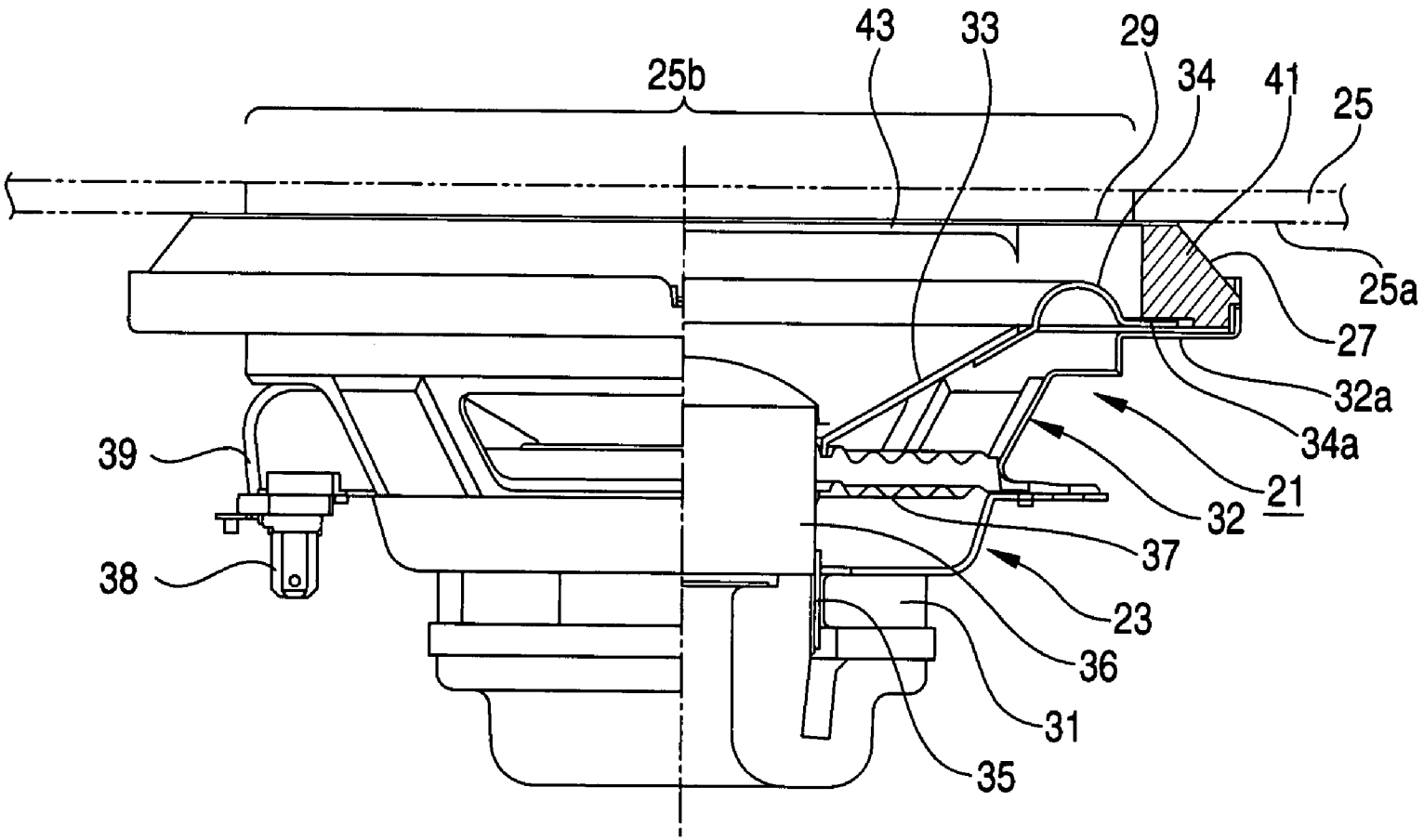
FIG. 3 is a semi-cross sectional view of a speaker apparatus in accordance with an embodiment of the invention.
Figure 4:
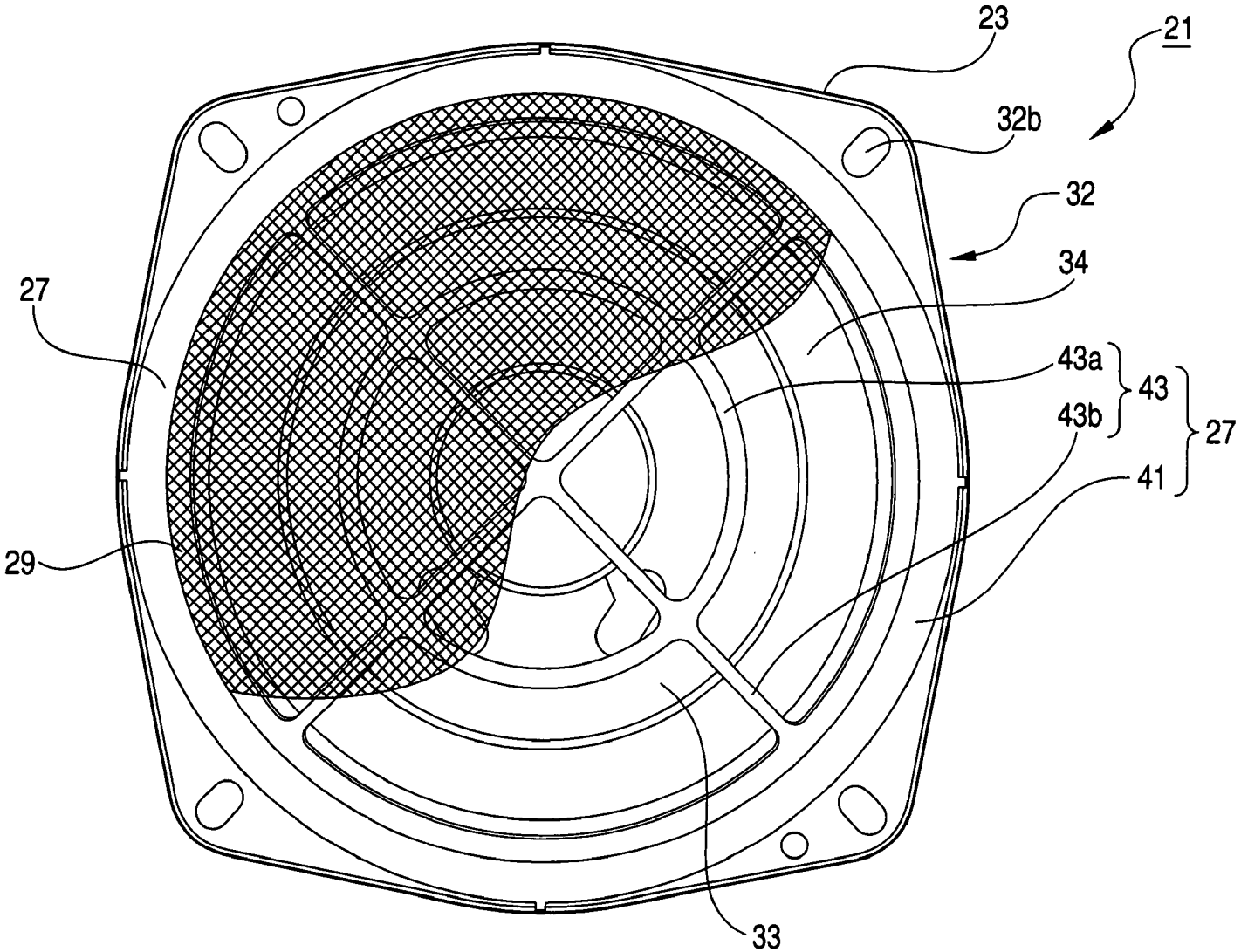
FIG. 4 is a front lavational view of the speaker apparatus shown in FIG. 3.

FIGS. 3 and 4 are a semi-cross sectional view and a front lavational view of a speaker apparatus in accordance with an embodiment of the invention.

As shown in FIG. 3, in a speaker apparatus 21 of this embodiment, a gasket 27 is interposed between a speaker unit 23 and a cabinet 25 to which the speaker unit 23 is fitted. A dust-proof net 29, which will be described later, is secured to the gasket 27.

The speaker unit 23 of this embodiment is a speaker unit of a so-called cone type, and a cone-shaped diaphragm 33 is disposed in a center of a speaker frame 32 with a magnetic circuit 31 assembled thereto.

An edge 34 having a loop-shaped cross section is joined to an outer peripheral portion of the diaphragm 33, and an outer peripheral edge 34*a* of this edge 34 is fixed to an edge-attaching flange portion 32*a* of the speaker frame 32.

A voice coil bobbin 36 with a voice coil 35 wound there around is joined to the center of the diaphragm 33. This voice coil bobbin 36 is disposed in a magnetic gap, which is formed in the magnetic circuit 31, so as to be movable in the direction of the central axis. At the same time, the voice coil bobbin 36 is floatingly supported with respect to the speaker frame 32 by a corrugated damper 37.

A pair of input terminals 38 are fitted to a rear surface of the speaker frame 32. Both ends of the voice coil bobbin 36 are connected to this pair of input terminals 38 through lead wires 39.

Although not shown, sound holes having appropriate bore diameters so as not to prevent the radiation of sound generated by the diaphragm 33 are penetratingly formed in a region 25*b* of the cabinet 25 opposing the diaphragm 33.

Attaching holes 32*b* (see FIG. 4) for attaching to the cabinet 25 are formed in the speaker frame 32, and the speaker unit 23 is fixed to the cabinet 25 by screw members which are passed through the attaching holes 32*b*.

The gasket 27 of this embodiment so structured that a circular ring-shaped annular portion 41, which is clamped between an inner surface 25*a* of the cabinet 25 and the edge-attaching flange portion 32*a* of the speaker frame 32 in the speaker unit 23, and supporting ribs 43, which are configured integrally on the inner side of the annular portion 41, are integrally formed of a synthetic resin or the like.

Further, as shown in FIG. 4, the supporting ribs 43 include straight ribs 43*b* provided along the radial direction of the annular portion 41, as well as an annular rib 43*a* provided concentrically on the inner side of the annular portion 41 in such a manner as to intersect the straight ribs 43*b*.

In the case of this embodiment, the arrangement provided is such that as the annular rib 43*a* one rib is provided, whereas as the straight ribs 43*b* four ribs are provided at 90° intervals about the central axis of the speaker.

The dust-proof net 29 is formed by cutting out a light-weight mesh sheet, which is fabricated from nylon fibers or the like, in conformity with the outside diameter of the front surface of the gasket 27. The dust-proof net 29 is heat welded and integrated by ultrasonic welding to both the annular portion 41 and the supporting ribs 43 which make up the gasket 27.

It should be noted that the gasket 27 of this embodiment functions to close a gap between the cabinet 25 and the speaker unit 23 and press the outer peripheral edge 34*a* of the edge 34 bonded to the outer peripheral portion of the diaphragm 33 against the frame 32 of the speaker unit 23.

According to the above-described speaker apparatus 21 of this embodiment, as for the gasket 27 to which the dust-proof net 29 is welded, its mechanical strength increases since the annular portion 41 which is clamped between the speaker unit 23 and the cabinet 25 is reinforced by the supporting ribs 43 configured integrally on its inner side. Therefore, it is possible to prevent the occurrence of slackening or exfoliation of the dust-proof net 29 due to the partial deformation of the gasket 27.

In addition, since the supporting ribs 43 which are configured integrally on the inner side of the annular portion 41 of the gasket 27 function as welds for both the annular portion 41 and the dust-proof net 29, the welding area with respect to the dust-proof net 29 increases. Hence, it is possible to secure sufficient fixing strength by virtue of an increase in the welding area.

Accordingly, it is possible to reduce the expansion and shrinkage of the dust-proof net 29 due to temperature changes or humidity changes, thereby making it possible to prevent the occurrence of the slackening or exfoliation in the dust-proof net 29. In addition, it is possible to prevent the slackening of the dust-proof net 29 at the time of heat welding by ultrasonic welding, and the welding operation of the dust-proof net 29 with respect to the gasket 27 can be facilitated.

Furthermore, as for the gasket 27 of this embodiment, the supporting ribs 43 include the straight ribs 43*b* provided along the radial direction of the annular portion 41 and the annular rib 43*a* provided concentrically on the inner side of the annular portion 41 in such a manner as to intersect the straight ribs 43b. Therefore, the ribs having different extending directions are joined in such a manner as to intersect each other, and directions in which the strength of the gasket itself is increased by the supporting ribs 43 become multiple directions. Hence, it is possible to realize uniformly increased strength which has no directionality over the entire region of the gasket 27.

Moreover, the welded surface of the gasket 27 with respect to the dust-proof net 29 are uniformly dispersed over the substantially entire region of the dust-proof net 29 by virtue of the presence of the straight ribs 43*b* and the annular rib 43*a* disposed in such a manner as to intersect each other, as described above. Therefore, it is possible to make small and uniform the intervals between the welds of the gasket 27 with respect to the dust-proof net 29, and effectively suppress the occurrence of the slackening and exfoliation of the dust-proof net 29.

Accordingly, the speaker apparatus 21 of this embodiment makes it possible to prevent the dust-proof net in which the slackening or exfoliation has occurred from generating abnormal noise by resonating with the vibration of the speaker unit 23.

It should be noted that the configuration of the speaker unit, the cabinet, the supporting ribs, the straight ribs, the annular rib, and the like in the gasket and the speaker apparatus in accordance with the invention are not limited to those of the above-described embodiment. It goes without saying that it is possible to employ various forms on the basis of the gist of the invention.

For example, the numbers, intervals, and the like of the annular ribs 43*a* and the straight ribs 43*b* which are formed integrally with the gasket 27 are not limited to those of the above-described embodiment, and are appropriately selected in correspondence with necessary welding strength for welding the dust-proof net 29 and the gasket 27. However, the supporting ribs must be provided so as not to hamper the radiation of sound from the diaphragm 33 of the speaker unit 23, and are desirably formed in slender shape, for instance.

In addition, although, as for the gasket 27 in the above-described embodiment, its annular portion 41 is formed in the shape of a circular ring in correspondence with the cone-shaped diaphragm 33, the annular portion may be formed in an elliptical shape, a flat oval shape, or the like in correspondence with the shape of the diaphragm.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A gasket interposed between a speaker unit and a cabinet to which the speaker unit is attached, comprising:

a dust-proof net;

an annular portion clamped between the speaker unit and the cabinet; and a supporting rib configured integrally on an inner side of the annular portion, wherein the dust-proof net is secured to the annular portion and the supporting rib, wherein the supporting rib includes straight ribs provided along a radial direction of the annular portion, and an annular rib provided concentrically on an inner side of the annular portion, wherein the annular rib is configured to intersect the straight ribs, and wherein the dust-proof net is welded to the straight ribs and annular rib.

2. A speaker apparatus comprising:

a gasket interposed between a speaker unit and a cabinet to which the speaker unit is attached, wherein the gasket is configured integrally with:

an annular portion clamped between the speaker unit and the cabinet; and a supporting rib configured integrally on an inner side of the annular portion, and a dust-proof net secured to the annular portion and the supporting rib, wherein the supporting rib includes straight ribs provided along a radial direction of the annular portion, and an annular rib provided concentrically on an inner side of the annular portion, and wherein the annular rib is configured to intersect the straight ribs, wherein the dust-proof net is welded to the straight ribs and annular rib, and wherein the cabinet is integrally fixed to the gasket and the speaker unit by a screw member which is passed through an attaching hole formed in the speaker unit.

* * * * *